US010509342B2

(12) United States Patent
Nieda

(10) Patent No.: US 10,509,342 B2
(45) Date of Patent: Dec. 17, 2019

(54) POWDER CONTAINER, PROCESS CARTRIDGE, IMAGE FORMING APPARATUS, AND MECHANICAL DEVICE

(71) Applicant: Hiroaki Nieda, Kanagawa (JP)

(72) Inventor: Hiroaki Nieda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/264,197

(22) Filed: Jan. 31, 2019

(65) Prior Publication Data

US 2019/0243284 A1 Aug. 8, 2019

(30) Foreign Application Priority Data

Feb. 6, 2018 (JP) ..... 2018-018880

(51) Int. Cl.
*G03G 15/08* (2006.01)
*G03G 21/18* (2006.01)
*G03G 21/16* (2006.01)

(52) U.S. Cl.
CPC ..... *G03G 15/0889* (2013.01); *G03G 21/1676* (2013.01); *G03G 21/1814* (2013.01)

(58) Field of Classification Search
CPC ..... G03G 15/0822; G03G 15/0887; G03G 15/0889; G03G 21/1676; G03G 21/1814; G03G 2215/0802; G03G 2215/085
See application file for complete search history.

(56) References Cited

U.S. PATENT DOCUMENTS

2011/0097124 A1* 4/2011 Koike ..... G03G 21/12 399/358
2012/0093541 A1* 4/2012 Koyama ..... G03G 15/0889 399/254
2018/0059577 A1* 3/2018 Eto ..... G03G 15/0889

FOREIGN PATENT DOCUMENTS

| | | |
|---|---|---|
| JP | 60-221778 | 11/1985 |
| JP | 8-044172 | 2/1996 |
| JP | 9-185232 | 7/1997 |
| JP | 2010-060597 | 3/2010 |
| JP | 2013-044939 | 3/2013 |

* cited by examiner

*Primary Examiner* — Sophia S Chen
(74) *Attorney, Agent, or Firm* — Duft & Bornsen, PC

(57) ABSTRACT

A powder container includes a powder storage configured to store powder and having side walls with through-holes; a hollow member including a hollow part; held parts disposed at both ends of the hollow member in an axial direction of the hollow member; a coil configured to be held by the hollow member; holders configured to hold the held parts of the hollow member; and a piercing shaft configured to be inserted into the hollow part of the hollow member from outside of the powder container through one of the through-holes.

13 Claims, 14 Drawing Sheets

POWDER CONTAINER, PROCESS CARTRIDGE, IMAGE FORMING APPARATUS, AND MECHANICAL DEVICE

CROSS-REFERENCE TO RELATED APPLICATION

This patent application is based on and claims priority pursuant to 35 U.S.C. § 119(a) to Japanese Patent Application No. 2018-018880, filed on Feb. 6, 2018, in the Japan Patent Office, the entire disclosure of which is hereby incorporated by reference herein.

BACKGROUND

Technical Field

This disclosure generally relates to a powder container to store powder therein, a process cartridge including the powder container, an image forming apparatus, and a mechanical device including a rotator.

Description of the Related Art

There is known an image forming apparatus, such as a copier, a printer, and a facsimile machine, including a mechanical device such as a powder container that rotatably holds a rotator such as a stirrer (a screw coil, a coil spring, and the like).

SUMMARY

According to embodiments of the present disclosure, an improved powder container includes a powder storage configured to store powder and having side walls with through-holes; a hollow member including a hollow part; held parts disposed at both ends of the hollow member in an axial direction of the hollow member; a coil configured to be held by the hollow member; holders configured to hold the held parts of the hollow member; and a piercing shaft configured to be inserted into the hollow part of the hollow member from outside of the powder container through one of the through-holes.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
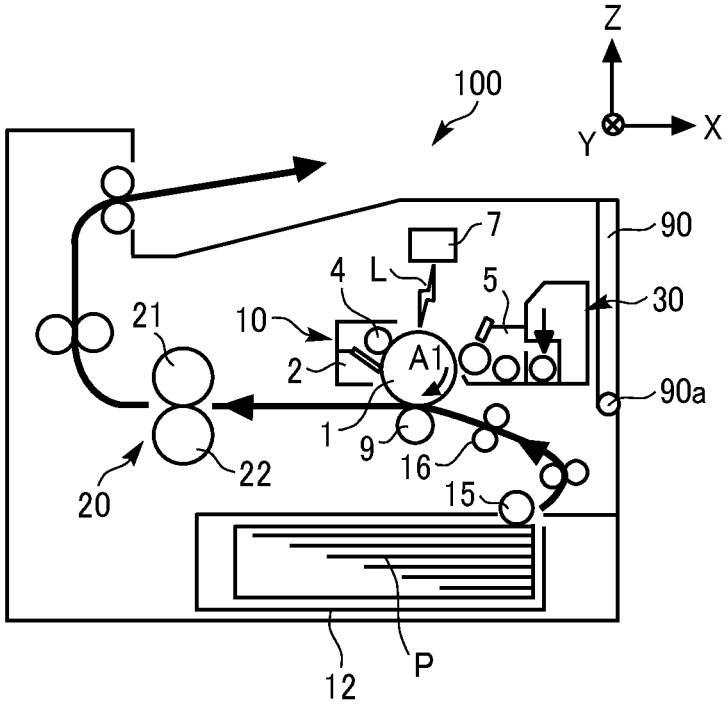
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

With reference to the drawings, embodiments of the present disclosure are described below. It is to be understood that identical or similar reference numerals are assigned to identical or corresponding components throughout the drawings, and redundant descriptions are omitted or simplified below as appropriate.

Now, a description is given of a configuration and operation of an image forming apparatus 100 with reference to FIG. 1.

In FIG. 1, the image forming apparatus 100 that is a printer in the present embodiment includes a photoconductor drum 1 on which a toner image is formed, and an exposure device (a writing device) 7. The exposure device 7 irradiates the photoconductor drum 1 with exposure light L based on image data input from an input device such as a personal computer.

The image forming apparatus 100 further includes: a transfer roller 9 to transfer the toner image borne on a surface of the photoconductor drum 1 to a sheet P conveyed to a transfer nip (a transfer position); a process cartridge 10 uniting the photoconductor drum 1, a charging roller 4, a developing device 5, a cleaner 2, and a waste toner conveyor 6 (see FIG. 2); and a sheet feeder (a sheet tray) 12 to accommodate the sheets P such as paper sheets.

The image forming apparatus 100 yet further includes a registration roller pair (a timing roller pair) 16 to feed the sheet P toward the transfer nip where the photoconductor drum 1 contacts the transfer roller 9, a fixing device 20 to fix an unfixed image on the sheet P, and a toner container 30 as a powder container (a mechanical device). The fixing device 20 includes a fixing roller 21 and a pressure roller 22.

Around the photoconductor drum 1, the charging roller 4, the developing device 5, the cleaner 2, and the waste toner conveyor 6 are disposed. The above components (i.e., the photoconductor drum 1, the charging roller 4, the developing device 5, the cleaner 2, and the waste toner conveyor 6) are united as the process cartridge 10. The process cartridge 10 is removably installed in the body of the image forming apparatus 100. The process cartridge 10 is replaced with a new process cartridge in a certain replacement cycle.

Above the process cartridge 10 (the developing device 5) as a removable component, the toner container 30 as the powder container is removably (replaceably) installed in the body of the image forming apparatus 100. The toner container 30 (a toner storage 31) stores toner (fresh toner) as powder. The toner is appropriately supplied from the toner container 30 to the inside of the developing device 5. When the toner container 30 runs out of toner (or toner contained in the developing device 5 is depleted), the toner container 30 is replaced with a new toner container. Note that, the toner container 30 according to the present embodiment further includes a waste toner collection portion (a powder collection portion) 32 in addition to the toner storage (a powder storage) 31. The waste toner collection portion 32 is described in detail later.

Figure 2:
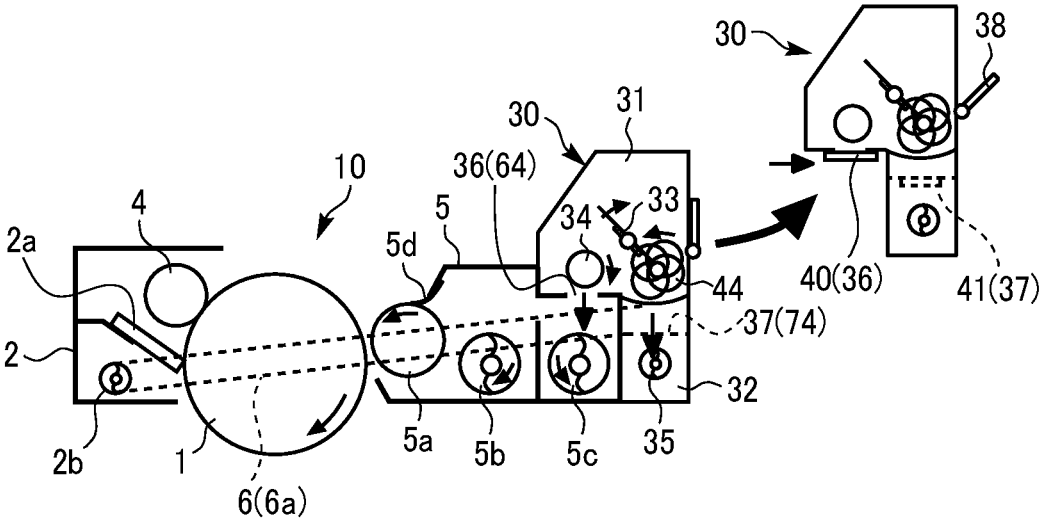
FIG. 2 is a schematic view of a process cartridge and a toner container according to an embodiment of the present disclosure.

Now, a description is given of regular image forming operations performed by the image forming apparatus 100 with reference to FIGS. 1 and 2.

With reference to FIG. 1, as image data is transmitted from the input device, such as a personal computer, to the exposure device 7 in the image forming apparatus 100, the exposure device 7 irradiates the surface of the photoconductor drum 1 with the exposure light (a laser beam) L based on the image data.

Meanwhile, the photoconductor drum 1 rotates in a direction indicated by arrow A1 in FIG. 1, that is, a clockwise direction. The charging roller 4 uniformly charges the surface of the photoconductor drum 1 at an opposing position (a charging process). As a result, a charging potential is formed on the surface of the photoconductor drum 1. In the present embodiment, the charging potential on the photoconductor drum 1 is approximately −900V. The charged surface of the photoconductor drum 1 thereafter reaches an irradiation position of the exposure light L. An irradiated portion of the photoconductor drum 1 with the exposure light L has a latent image potential (about 0 to −100 V) and an electrostatic latent image is formed on the surface of the photoconductor drum 1 (an exposure process).

The surface of the photoconductor drum 1 bearing the electrostatic latent image thereon reaches a position where the photoconductor drum 1 is opposed to the developing device 5. The developing device 5 supplies toner onto the photoconductor drum 1, and the latent image formed on the photoconductor drum 1 is thereby developed into a toner image (a developing process).

As illustrated in FIG. 2, the developing device 5 includes the developing roller 5*a*, two conveying screws 5*b* and 5*c*, and a doctor blade 5*d*. The developing device 5 contains toner (one-component developer). Toner is supplied from a discharge port 36 of the toner container 30 (the toner storage 31) to the developing device 5 via an inlet port 64 of the developing device 5 according to consumption of toner in the developing device 5. The two conveying screws 5*b* and 5*c* stir and mix the supplied toner with the toner contained in the developing device 5 while circulating the toner in a longitudinal direction of the developing device 5, which is a direction perpendicular to the surface of the paper on which FIG. 2 is drawn. The developing roller 5*a* scoops up a part of the toner conveyed by the conveying screw 5*b*. The toner scooped up by the developing roller 5*a* is quantified by the doctor blade 5*d* and reaches a position (a development range) opposed to the photoconductor drum 1. At that time, the toner on the developing roller 5*a* is rubbed by the doctor blade 5*d* and triboelectrically charged. The quantified toner adheres to the electrostatic latent image on the photoconductor drum 1 at the development range, thereby forming the toner image on the photoconductor drum 1. The developing roller 5*a* and the two conveying screws 5*b* and 5*c* are rotated in directions indicated by arrows in FIG. 2 by a drive motor included in the image forming apparatus 100, respectively.

After the developing process, the surface of the photoconductor drum 1 bearing the toner image thereon reaches the transfer nip (the transfer position) formed between the photoconductor drum 1 and the transfer roller 9. In the transfer nip between the photoconductor drum 1 and the transfer roller 9, a transfer bias, which has a polarity opposite to toner, is applied from a power source to the transfer roller 9, and the toner image formed on the photoconductor drum 1 is thereby transferred onto the sheet P fed by the registration roller pair 16 (a transfer process).

The surface of the photoconductor drum 1 after the transfer process reaches a position opposed to the cleaner 2. At this position, untransferred toner remaining on the surface of the photoconductor drum 1 is mechanically removed by a cleaning blade 2*a* and collected in the cleaner 2 (a cleaning process).

A series of image forming processes on the photoconductor drum 1 is thus completed.

A collection screw 2*b* conveys the untransferred toner collected in the cleaner 2 to one end of the cleaner 2 in a width direction (a rotation axis direction) of the collection screw 2*b*. The waste toner conveyor 6 including a waste toner coil 6*a* conveys the untransferred toner in a diagonally upper right direction in FIG. 2. Thus, the untransferred toner is collected in the waste toner collection portion 32 of the toner container 30 as waste toner from an outlet port 74 of the waste toner conveyor 6 via a collection port 37 of the toner container 30.

In the new toner container 30, the toner storage 31 is filled with fresh toner, and the waste toner collection portion 32 is empty.

The sheet P is conveyed to the transfer nip (i.e., the transfer position) between the photoconductor drum 1 and the transfer roller 9 as follows.

First, a feed roller 15 feeds the topmost sheet P of the stack of sheets P accommodated in the sheet feeder 12 toward a conveyance path.

Thereafter, the sheet P reaches the registration roller pair 16. The sheet P that has reached the registration roller pair 16 is fed to the transfer nip (i.e., the contact position of the transfer roller 9 with the photoconductor drum 1) in synchronization with an entry of the toner image formed on the photoconductor drum 1 into the transfer nip.

After the transfer process, the sheet P passes through the transfer nip (i.e., the position of the transfer roller 9) and reaches the fixing device 20 through the conveyance path. In the fixing device 20, the sheet P is interposed between the fixing roller 21 and the pressure roller 22. The toner image is fixed on the sheet P by heat applied from the fixing roller 21 and pressure applied from both the fixing roller 21 and the pressure roller 22. The sheet P having the fixed toner image thereon is discharged from the fixing nip formed between the fixing roller 21 and the pressure roller 22, ejected from the body of the image forming apparatus 100, and stacked on an output tray.

Accordingly, a series of the image forming processes is completed.

Figure 3A:
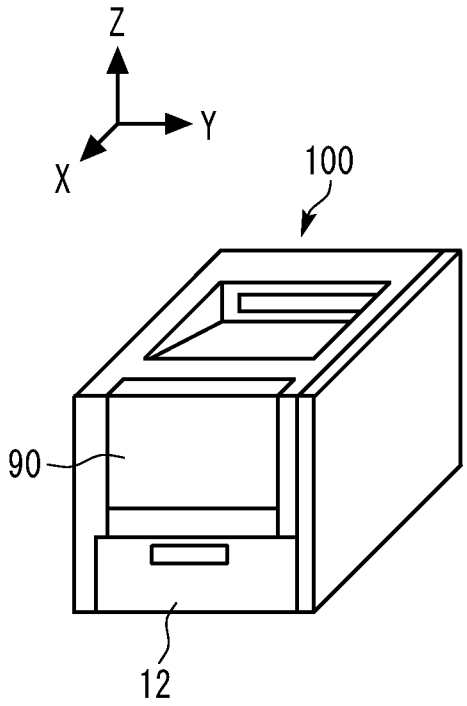
FIG. 3A is a perspective view of the image forming apparatus with a cover closed according to an embodiment of the present disclosure.
Figure 3B:
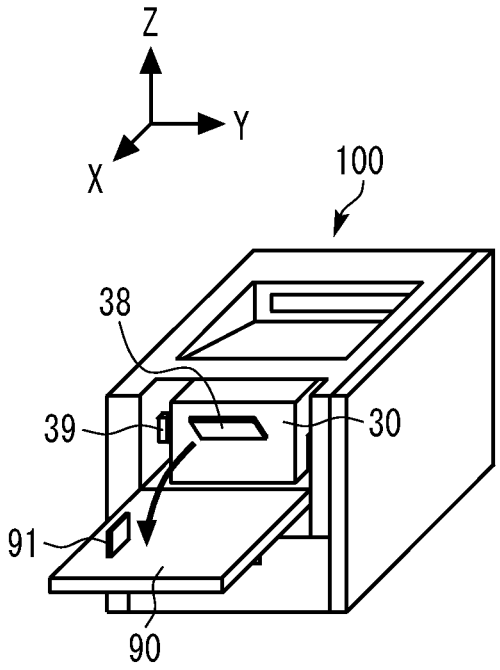
FIG. 3B is a perspective view of the image forming apparatus with the cover open according to an embodiment of the present disclosure.

According to the present embodiment, the image forming apparatus 100 is covered with a plurality of exterior covers as illustrated in FIG. 3A. As illustrated in FIG. 3B, a part of a front exterior cover functions as a cover 90 that is rotatable.

More specifically, the cover 90 is secured to the image forming apparatus 100 and hinged around a spindle (a rotation center shaft) 90*a* as illustrated in FIG. 1. As the cover 90 rotates counterclockwise in FIG. 1 around the spindle 90*a*, the cover 90 closes as illustrated in FIGS. 1 and 3A. As the cover 90 rotates clockwise in FIG. 1 around the spindle 90*a*, the cover 90 opens as illustrated in FIG. 3B.

In the present embodiment, as illustrated in FIG. 3B, the toner container (the powder container) 30 is revealed to be installable in and removable from the image forming apparatus 100 when the cover 90 opens. By opening the cover 90, the toner container 30 alone (illustrated in FIG. 7) can be replaced with a new toner container, or the toner container 30 together with the process cartridge 10 can be replaced with a new one (the process cartridge 10 and the toner container 30 illustrated in FIG. 4).

Image forming processes (printing operations) described above with reference to FIG. 1 are performed when the cover 90 closes as illustrated in FIG. 1.

The configuration and operation of the toner container (the powder container) 30 according to the present embodiment are described in further detail below.

In the present embodiment, as illustrated in FIG. 2, the toner container 30 as the powder container is attachable to and detachable from the process cartridge 10. In particular, in the present embodiment, the toner container 30 is attachable to and detachable from the process cartridge 10 in both states in which the process cartridge 10 is installed in the image forming apparatus 100 and in which the process cartridge 10 is removed from the image forming apparatus 100.

As described above with reference to FIG. 3B, the toner container 30 is attachable to and detachable from the process cartridge 10 installed in the image forming apparatus 100. In other words, the toner container 30 as the powder container is indirectly installable in and removable from the image forming apparatus 100.

In the present embodiment, the toner container 30 is indirectly installable in and removable from the image forming apparatus 100. Alternatively, the toner container 30 can be directly installable in and removable from the image forming apparatus 100.

The process cartridge 10 is the removable component that is installable in and removable from the image forming apparatus 100. Besides the process cartridge 10, the developing device 5 and other devices can function as the removable components. The toner container (the powder container) 30 can be attachable to and detachable from a removable component other than the process cartridge 10.

Figure 4:
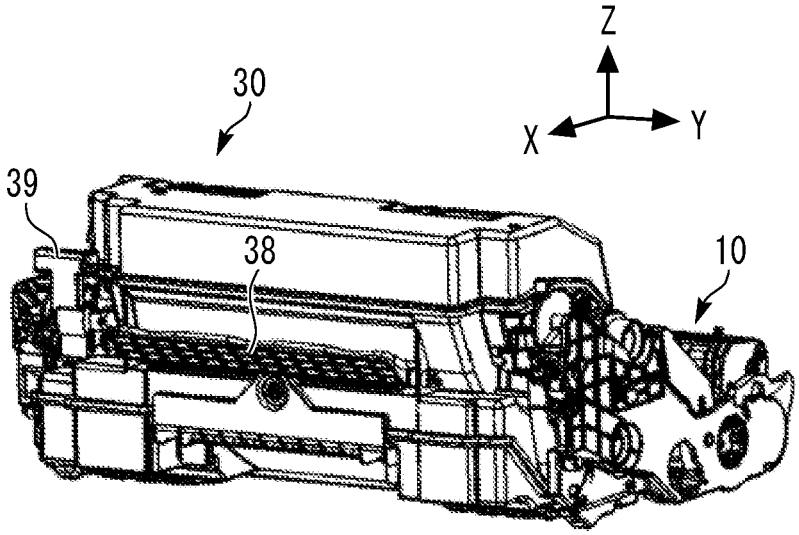
FIG. 4 is a perspective view of the process cartridge to which the toner container is attached.
Figure 5:
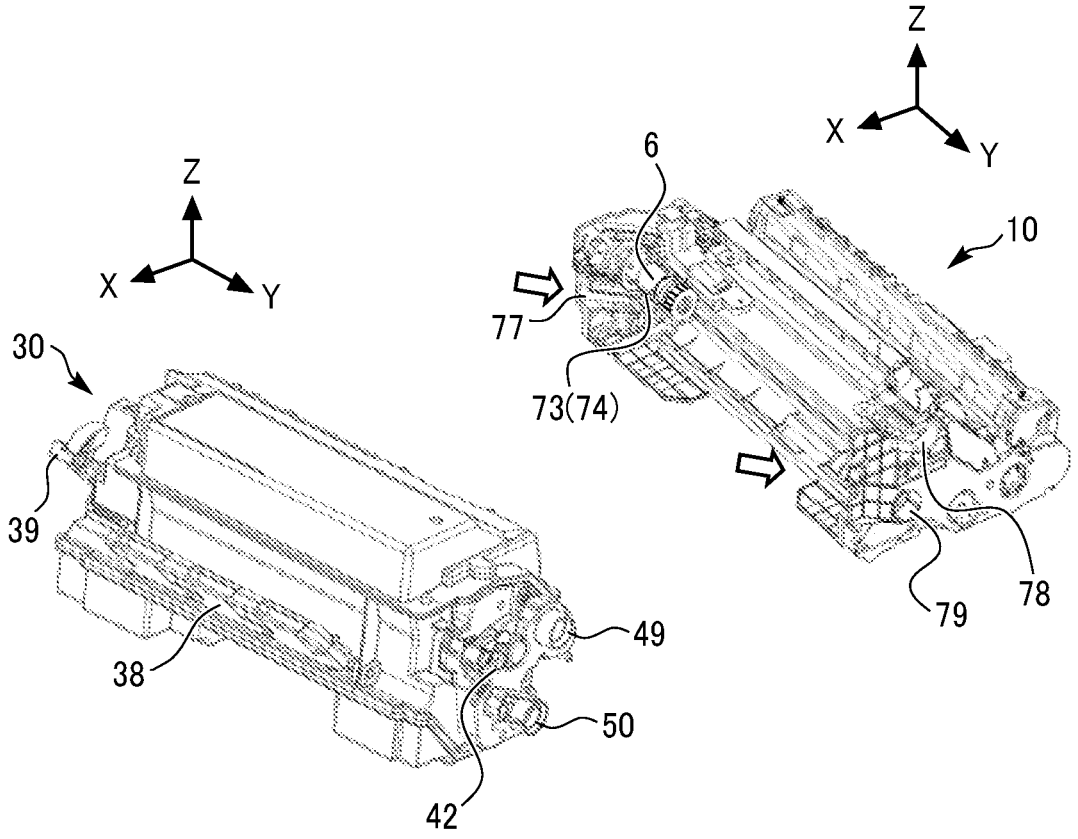
FIG. 5 is a perspective view of the process cartridge from which the toner container is detached.
Figure 6A:
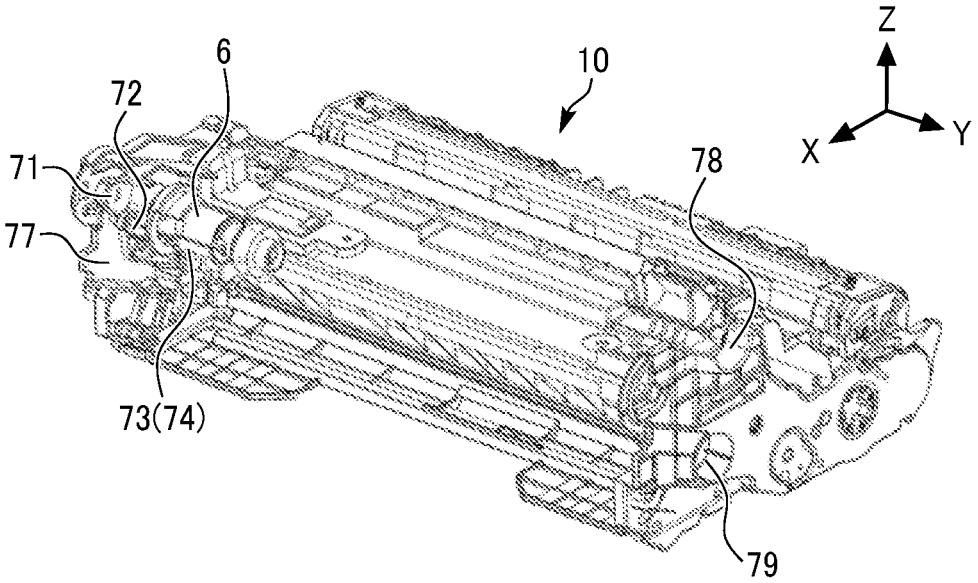
FIGS. 6A and 6B are perspective views of the process cartridge.
Figure 6B:
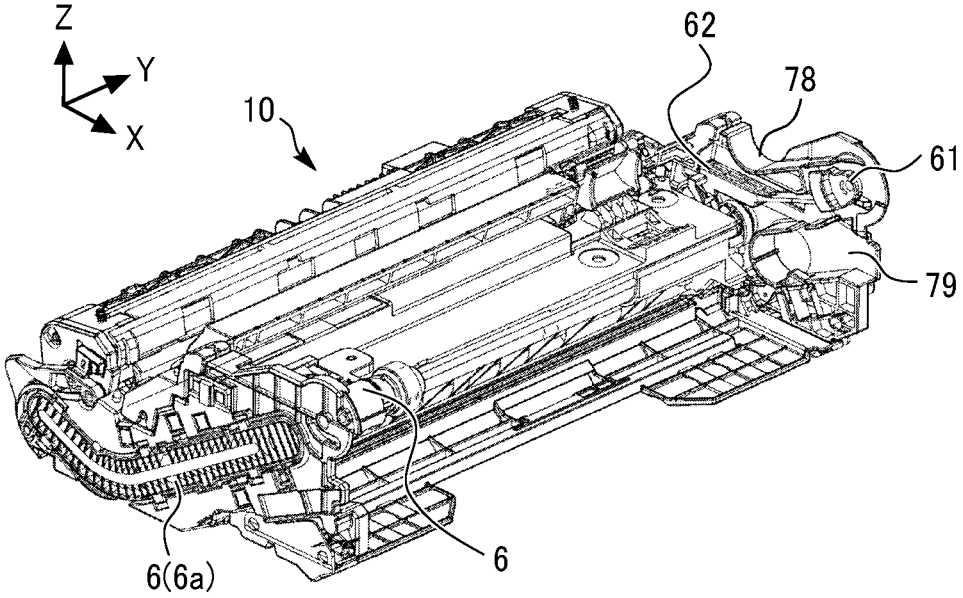
Figure 7:
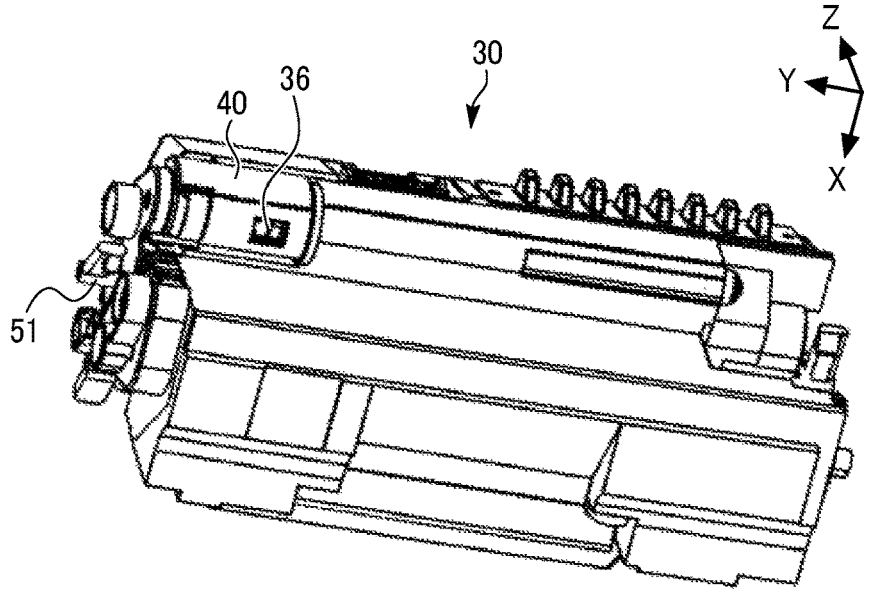
FIG. 7 is a perspective view of the toner container with a first shutter (a discharge port) open when viewed from below.

Furthermore, as illustrated in FIG. 4, a single removable component (a united component formed of the toner container 30 and the process cartridge 10) in which the toner container 30 is attached to the process cartridge 10 is installable in and removable from the image forming apparatus 100. As illustrated in FIG. 5, the toner container 30 can be attached to the process cartridge 10, moving in a predetermined direction indicated by a white arrow in FIG. 5. On the other hand, the toner container 30 can be removed from the process cartridge 10, moving in a direction opposite to the predetermined direction. The toner container 30 alone as illustrated in FIG. 7 is distributed in the market. The process cartridge 10 alone as illustrated in FIGS. 6A and 6B is similarly distributed in the market.

When the toner container 30 is attached to or detached from the process cartridge 10 (or the image forming apparatus 100), an operator, such as a user, pulls out or pushes in the toner container 30, while gripping a handle 38 of the toner container 30. The handle 38 is attached to the front side of the toner container 30 in a direction of detachment operation (positive X-direction) as illustrated FIGS. 2 to 5. The handle 38 is foldable. When the cover 90 closes in a state in which the toner container 30 is installed in the image forming apparatus 100 with the handle 38 standing up as illustrated in FIGS. 4 and 5, the handle 38 is pushed by the cover 90 in conjunction with movement of the cover 90 from an open state to a closed state, thereby accommodating the handle 38 along an exterior of the toner container 30.

Figure 8:
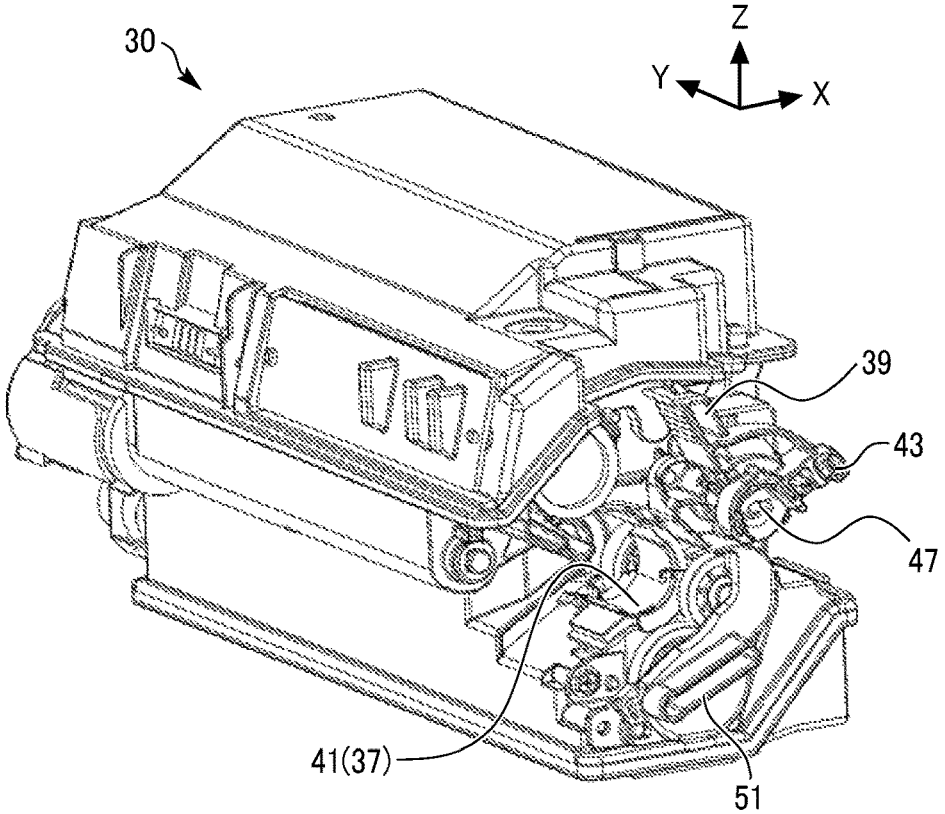
FIG. 8 is a perspective view of the toner container with a second shutter (a collection port) closed when viewed from the collection port side.

The toner container 30 includes first and second positioning portions 49 and 50 illustrated in FIG. 5, and a guide 51 illustrated in FIGS. 7 and 8. The process cartridge 10 has multiple guide grooves 77 and 79, and a guide receiver 78 illustrated in FIG. 5. The first and second positioning portions 49 and 50 and the guide 51 engage with the guide receiver 78 and the multiple guide grooves 79 and 77, respectively. Thus, the toner container 30 can be attached to and detached from the process cartridge 10 and positioned in the process cartridge 10.

Specifically, the first and second positioning portions (positioning projections) 49 and 50 project from one end face of the toner container 30 in the width direction of the toner container 30 (positive Y-direction). The guide receiver 78 and the guide groove 79 are formed on one end face of the process cartridge 10 corresponding the one end face of the toner container 30. The guide 51 projects from the other end face of the toner container 30 (negative Y-direction) and has a rectangular shape which is inclined upward in positive X-direction. The guide receiver 78 introduces the first positioning portion 49, the guide groove 79 introduces the second positioning portion 50, and the guide groove 77 formed at the other end face of the process cartridge 10 introduces the guide 51. Thus, the toner container 30 is attached to the process cartridge 10. The toner container 30 is positioned in the process cartridge 10 so that the first and second positioning portions 49 and 50 engage with dead ends of the guide receiver 78 and the guide groove 79, respectively, and the guide 51 engages with a dead end of the guide groove 77.

The first positioning portion 49 is a projection surrounding a coupling that transmits driving force from the image forming apparatus 100 to an agitator 33 (see FIGS. 2 and 9) to stir toner. The second positioning portion 50 is a projection surrounding a coupling gear to rotate a conveying screw 35 (see FIGS. 2 and 9). As described above, input portions to receive the driving force from the image forming apparatus 100 are disposed near (inside) the first and second positioning portions 49 and 50, enabling reliable driving force transmission.

The toner container (the powder container) 30 includes the discharge port 36, a collection port 37, a first shutter 40, and a second shutter 41.

Figure 9:
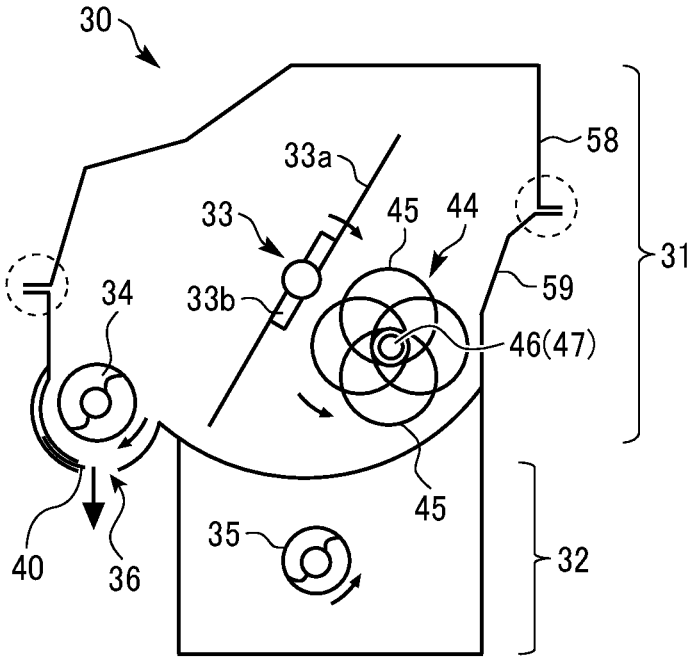
FIG. 9 is a schematic view of an inside of the toner container.

With reference to FIGS. 2, 7, and 9, the discharge port 36 of the toner container 30 is an opening for discharging toner (powder) stored in the toner container 30 (the toner storage 31) to the developing device 5. The discharge port 36 communicates with the inlet port 64 of the developing device 5 when the toner container 30 is attached to the process cartridge 10. The inlet port 64 is an opening disposed above the conveying screw 5*c*.

Figure 10:
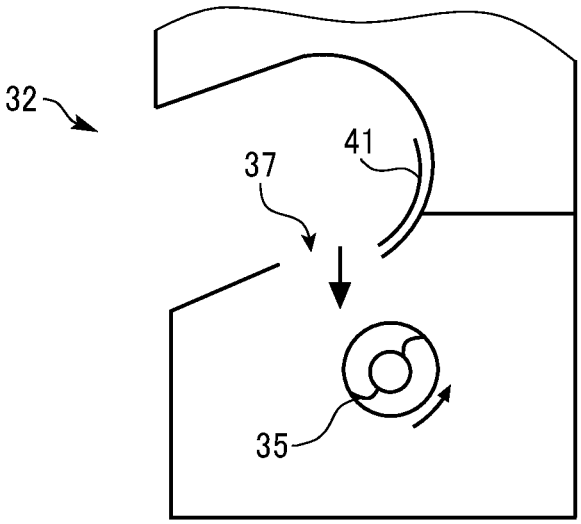
FIG. 10 is a schematic view illustrating a waste toner collection portion of the toner container.

With reference to FIGS. 2, 8, and 10, the collection port 37 of the toner container 30 is an opening to receive waste toner (untransferred toner) as powder from the outside of the toner container 30 and to collect the waste toner in the toner container 30. The collection port 37 communicates with the outlet port 74 of the waste toner conveyor 6 when the toner container 30 is attached to the process cartridge 10. The outlet port 74 (see FIGS. 5 and 6) is an opening disposed on a bottom face of a downstream end of the waste toner conveyor 6 in a direction of conveyance of the waste toner.

In the toner container 30 according to the present embodiment, with reference to FIGS. 2, 9, and 10, the toner storage 31, as the powder storage, to store toner (powder) to be discharged from the discharge port 36 is separated from the waste toner collection portion 32 serving as the powder collection portion to collect the waste toner (powder) received from the collection port 37, by a wall.

The toner storage (the powder storage) 31 further includes a supply screw 34 to rotate clockwise in FIGS. 2 and 9, the agitator (a rotator) 33 to rotate clockwise in FIGS. 2 and 9, and a stirrer 44. The stirrer 44 is rotated counterclockwise in FIGS. 2 and 9 by contact with the agitator (the rotator) 33.

The supply screw 34 discharges a target amount of toner stored in the toner storage 31 from the discharge port 36 according to a drive timing and rotation duration controlled by a controller.

The agitator 33 rotates in a predetermined direction to stir toner stored in the toner storage 31 to prevent toner from aggregating. As illustrated in FIG. 9, the agitator 33 includes a rigid body 33*b* and a flexible member 33*a*. The rigid body 33*b* is plate-shaped and disposed across a rotation axis, and the flexible member 33*a* is made of a plastic sheet and attached to the rigid body 33*b* along the rigid body 33*b*. Both ends of the agitator 33 in the axial direction thereof are rotatably supported by the housing of the toner container 30 through a pair of bearings, respectively.

The stirrer 44 stirs toner in a region of the toner storage 31 where the agitator 33 does not sufficiently stir. The stirrer 44 includes a coil 45 including a plurality of divided coil portions 45*a* to 45*d* and a hollow member 46 to hold the coil 45. A piercing shaft 47 is inserted into the hollow member 46. The piercing shaft 47 is a single component included in a mechanism to open and close the first shutter 40 and the second shutter 41 in conjunction with each other. The configuration of the above components is described in detail later with reference to FIGS. 15 and 16.

In the waste toner collection portion (the powder collection portion) 32, the conveying screw (a waste toner conveying screw) 35 to rotate counterclockwise in FIG. 2 is disposed. The conveying screw 35 conveys waste toner so that the waste toner that flows through the collection port 37 does not accumulate near (under) the collection port 37 and is evenly collected (distributed) in the waste toner collection portion 32.

In the present embodiment, as an operator pivots a lever 39 in a state in which the toner container 30 is attached to the process cartridge 10 (or the image forming apparatus 100), the first shutter 40 (the discharge port 36) and the second shutter 41 (the collection port 37) simultaneously open and close. In addition to the first and second shutters 40 and 41, the inlet port 64 and the outlet port 74 of the process cartridge 10 also simultaneously open and close. Therefore, open and close failures of the first and second shutters 40 and 41 and first and second cartridge shutters 63 and 73 are prevented.

When the cover 90 opens in a state in which the toner container 30 is installed in the image forming apparatus 100, the lever 39 is revealed as illustrated in FIG. 3B so that the operator can operate the lever 39.

Figure 11:
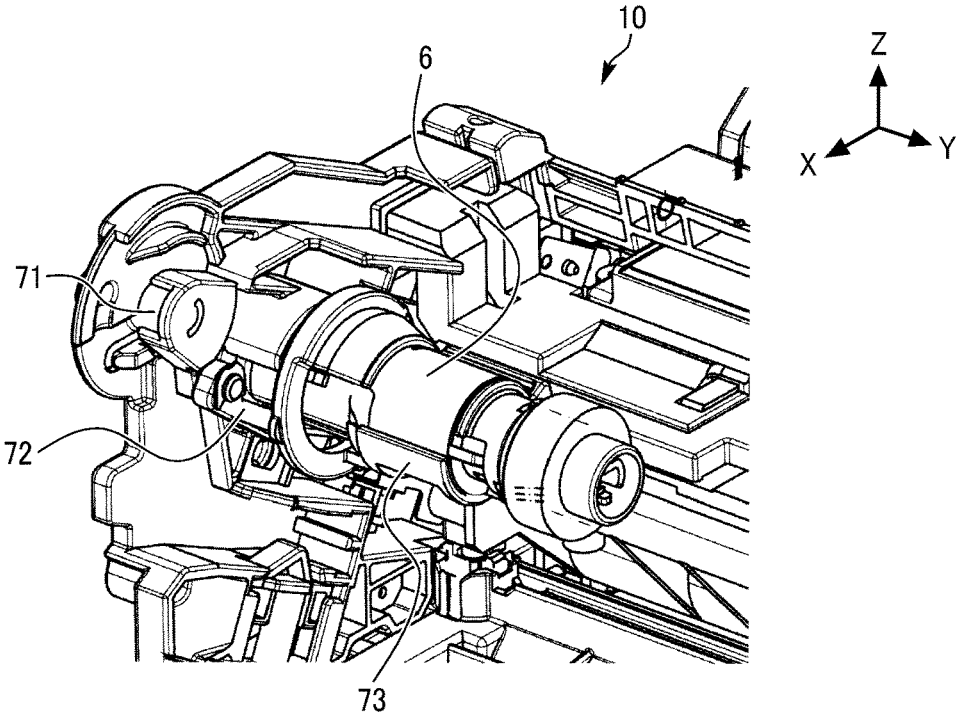
FIG. 11 is an enlarged perspective view illustrating a second engagement portion of the process cartridge.
Figure 12A:
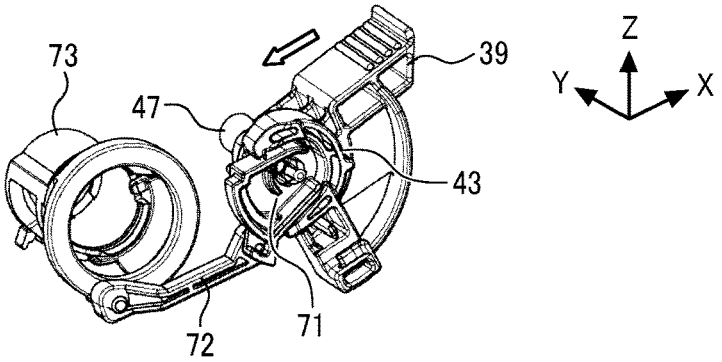
FIGS. 12A and 12B are perspective views illustrating a movement of a second cartridge shutter to open and close in the process cartridge.
Figure 12B:
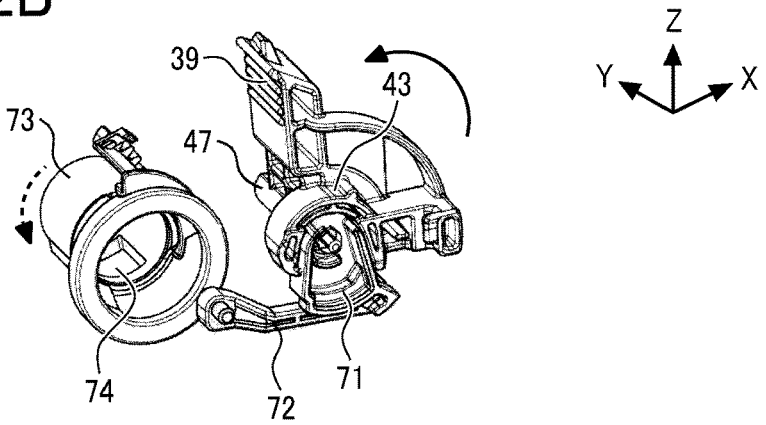

Specifically, as illustrated in FIGS. 8 and 12, the toner container 30 further includes the lever 39 and a second rotation portion 43. The second rotation portion 43 is formed together with the lever 39 as a single unit to rotate along with the lever 39. The second rotation portion 43 is engageable with a second engagement portion 71 (see FIGS. 11 and 12). The second engagement portion 71 is approximately arc-shaped and included in the process cartridge 10. Specifically, the second rotation portion 43 is shaped as a circle in which a part of the circle is missing in an arc shape. As illustrated in FIG. 12A, when the toner container 30 is attached to the process cartridge 10, the second engagement portion 71 of the process cartridge 10 is inserted in and engages with the second rotation portion 43 of the toner container 30. As illustrated in FIG. 12B, as the lever 39 rotates in a state in which the second engagement portion 71 of the process cartridge 10 engages with the second rotation portion 43 of the toner container 30, the second rotation portion 43 rotates along with the second engagement portion 71, thereby completing engagement of the process cartridge 10 and the toner container 30. Accordingly, the toner container 30 does not move in a direction of being pulled out from the process cartridge 10.

As the second rotation portion 43 is rotated along with the second engagement portion 71 by the lever 39 from a state of FIG. 12A to a state of FIG. 12B, a second link 72 coupled to the second engagement portion 71 of the process cartridge 10 moves in conjunction with the second engagement portion 71 in a direction to open the second cartridge shutter 73 of the process cartridge 10, thereby opening the outlet port 74. Further, the second cartridge shutter 73 that moves in the direction to open the second cartridge shutter 73 pushes the second shutter 41 in a direction to open the second shutter 41 of the toner container 30, thereby opening the collection port 37. As a result, the outlet port 74 of the process cartridge 10 communicates with the collection port 37 of the toner container 30. Thus, waste toner is delivered from the process cartridge 10 to the toner container 30 (the waste toner collection portion 32).

When the toner container 30 is detached from the process cartridge 10, the second rotation portion 43 rotates in a reverse direction opposite to the above-described direction along with a reverse rotation of the lever 39, and the second link 72 moves in conjunction with the second rotation portion 43, thereby closing the second cartridge shutter 73 (the outlet port 74) and the second shutter 41 (the collection port 37). As a result, the second rotation portion 43 of the toner container 30 disengages from the second engagement portion 71 of the process cartridge 10.

Figure 13:
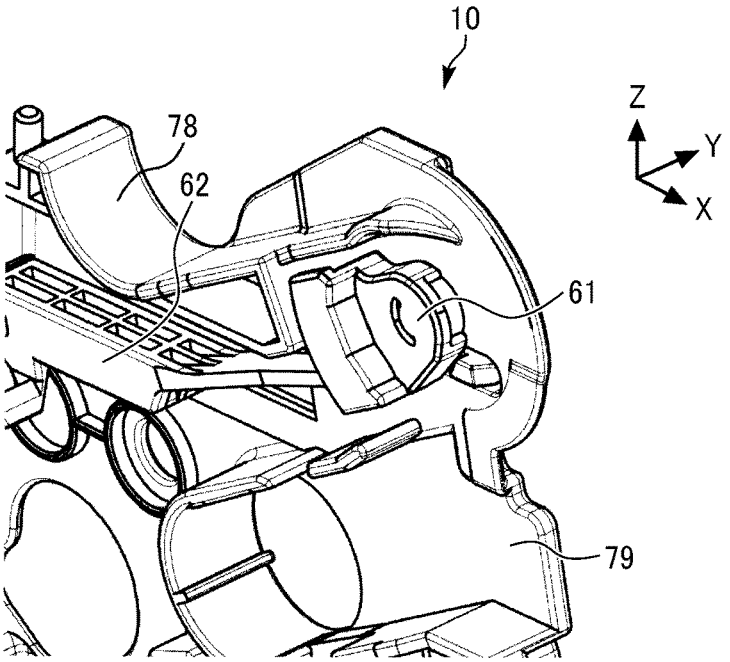
FIG. 13 is an enlarged perspective view illustrating a first engagement portion of the process cartridge.
Figure 14A:
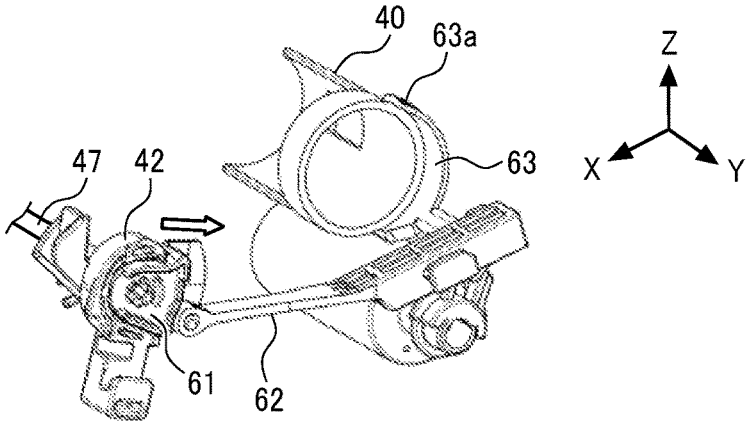
FIGS. 14A and 14B are perspective views illustrating a movement of a first cartridge shutter that opens and closes in the process cartridge.
Figure 14B:
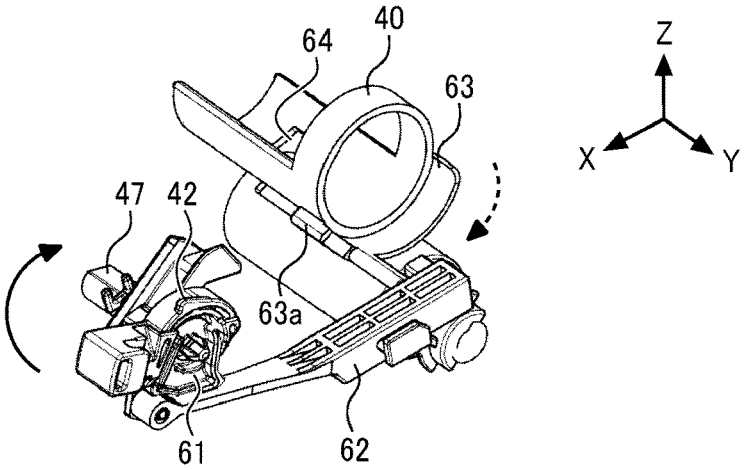
Figure 15:
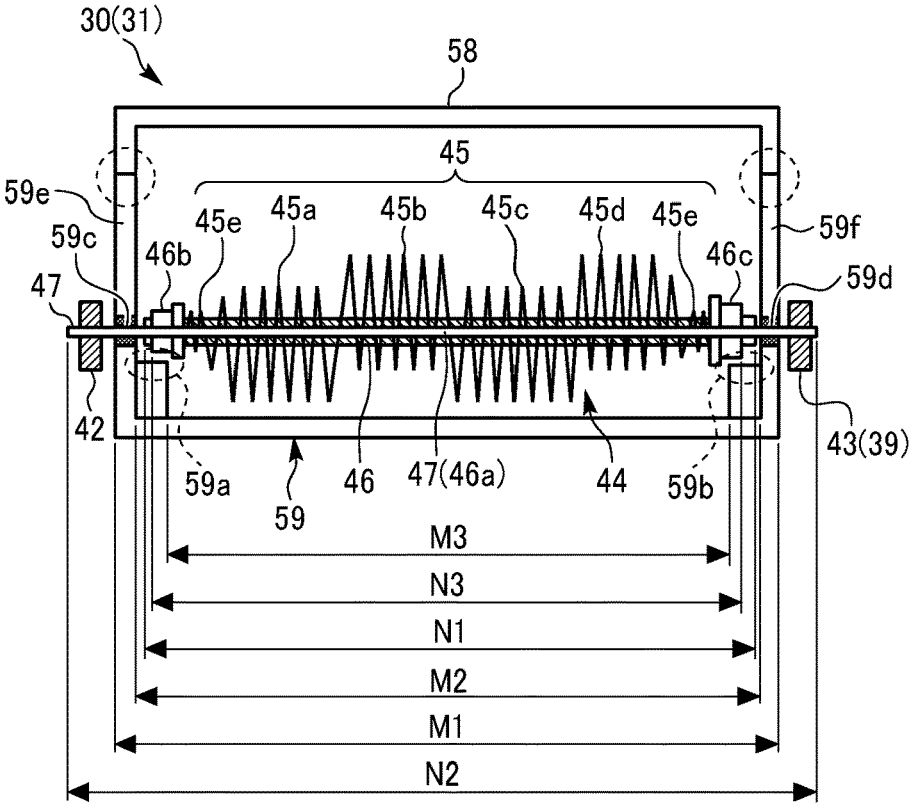
FIG. 15 a schematic view illustrating a toner storage of the toner container.

As illustrated in FIGS. 5, 14, and 15, the toner container 30 further includes a first rotation portion 42 disposed opposite the lever 39 (and the second rotation portion 43) in the width direction of the toner container 30. The first rotation portion 42 is coupled to the second rotation portion 43 via the piercing shaft 47 and rotates along with the lever 39 (, the second rotation portion 43, and the piercing shaft 47). The first rotation portion 42 is engageable with a first engagement portion 61 (see FIGS. 13, 14A, and 14B). The first engagement portion 61 is approximately arc-shaped and included in the process cartridge 10. Specifically, the first rotation portion 42 is shaped as a circle in which a part of circle is missing in an arc shape. As illustrated in FIG. 14A, when the toner container 30 is attached to the process cartridge 10, the first engagement portion 61 of the process cartridge 10 is inserted in and engages with the first rotation portion 42 of the toner container 30. As illustrated in FIG. 14B, as the lever 39 (and the second rotation portion 43) rotates in a state in which the first engagement portion 61 of the process cartridge 10 engages with the first rotation portion 42 of the toner container 30, the first rotation portion 42 rotates along with the first engagement portion 61 via the piercing shaft 47, thereby completing engagement of the process cartridge 10 and the toner container 30. Accordingly, the toner container 30 does not move in a direction of being pulled out from the process cartridge 10.

As the first rotation portion 42 rotates along with the first engagement portion 61 by the lever 39 from a state of FIG. 14A to a state of 14B, a first link 62 coupled to the first engagement portion 61 of the process cartridge 10 moves in conjunction with the first engagement portion 61 in a direction to open a first cartridge shutter 63 of the process cartridge 10, thereby opening the inlet port 64. Further, a pushing portion 63*a* of the first cartridge shutter 63 that moves in the direction to open the first cartridge shutter 63 pushes the first shutter 40 in a direction to open the first shutter 40 of the toner container 30, thereby opening the discharge port 36. As a result, the inlet port 64 of the process cartridge 10 communicates with the discharge port 36 of the toner container 30. Thus, fresh toner is delivered from the toner container 30 (the toner storage 31) to the process cartridge 10 (the developing device 5).

When the toner container 30 is detached from the process cartridge 10, the first rotation portion 42 rotates in a reverse direction opposite to the above-described direction along with a reverse rotation of the lever 39, and the first link 62 moves in conjunction with the first rotation portion 42, thereby closing the first cartridge shutter 63 (the inlet port 64) and the first shutter 40 (the discharge port 36). As a result, the first rotation portion 42 of the toner container 30 disengages from the first engagement portion 61 of the process cartridge 10.

If the toner container 30 is installed in the image forming apparatus 100 in a state in which the lever 39 falls as illustrated in FIG. 5, the lever 39 is pushed by a pushing member 91 (see FIG. 3B) of the cover 90 in conjunction with movement of the cover 90 from the open state to the closed state, simultaneously causing the first shutter 40 to open the discharge port 36, the first cartridge shutter 63 to open the inlet port 64, the second shutter 41 to open the collection port 37, and the second cartridge shutter 73 to open the outlet port 74. Therefore, a set failure of the toner container 30 can be prevented.

The pushing member 91 is not fixed to the cover 90 in a standing state as illustrated in FIG. 3B. The pushing member 91 is foldable and switchable between the standing state and a falling state. The pushing member 91 is in the falling state at the factory shipment. When the pushing member 91 is in the falling state, the lever 39 in the falling state as illustrated in FIG. 4 is not pushed by the pushing member 91 in the closed state of the cover 90. Accordingly, the discharge port 36 and the collection port 37 remain closed. The image forming apparatus 100 is shipped from a factory in a state in which the toner container 30 is installed in the image forming apparatus 100 with the discharge port 36 and the collection port 37 closed by the first and second shutters 40 and 41. Therefore, it is unnecessary to pack and ship the image forming apparatus 100 and the toner container 30 separately, and toner does not leak out of toner container 30 installed in the image forming apparatus 100 due to vibration during transport.

After arrival of the image forming apparatus 100 to a user, the user (or a service person) rotates the pushing member 91 to the standing state. This operation to rotate the pushing member 91 to the standing state is performed in a state in which the cover 90 is open (and the first and second shutters 40 and 41 remain closed). As the user (or the service person) only closes the cover 90 after erecting the pushing member 91, the first and second shutters 40 and 41 open. As a result, toner is supplied from the toner container 30 to the empty developing device 5, and the developing device 5 becomes available in use.

A distinctive configuration and an operation of the toner container (the powder container) 30 according to the present embodiment are described below.

As described above with reference to FIGS. 2 and 9, in the toner container 30 as the powder container (the mechanical device) according to the present embodiment, the stirrer 44 is rotatably provided to stir toner (powder) stored in the toner container 30 (the toner storage 31). The agitator 33 as the rotator is disposed adjacent to the stirrer 44 and rotates in a predetermined direction (e.g., clockwise in the present embodiment).

Figure 16:
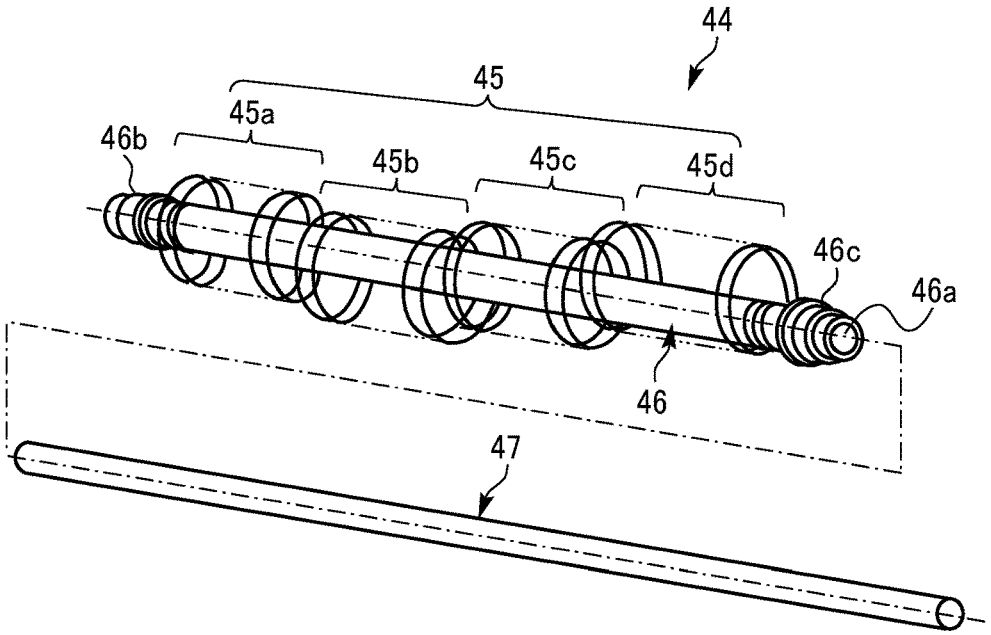
FIG. 16 is a perspective view illustrating a stirrer and a piercing shaft of the toner container.
Figure 17:
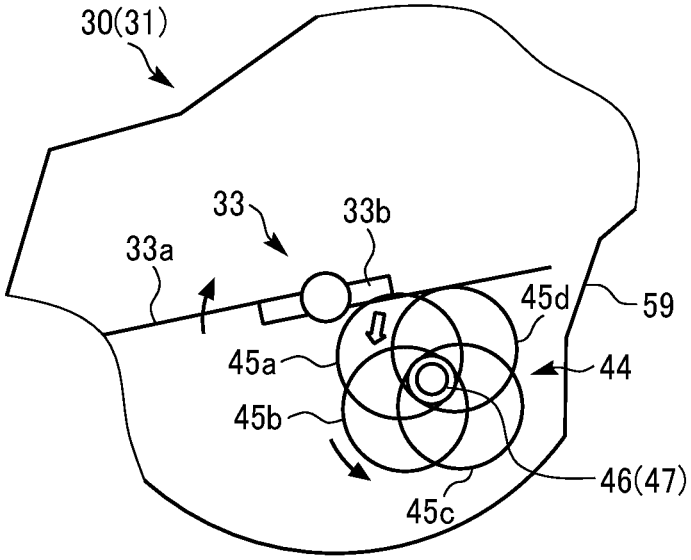
FIG. 17 is an enlarged schematic view illustrating the stirrer and an agitator of the toner container.

As illustrated in FIGS. 15 to 17, the stirrer 44 includes the hollow member 46, the coil 45, and the like.

Inside the hollow member 46 of the stirrer 44, a hollow part 46*a* extends in the axial direction of the stirrer 44 (in the left and right direction in FIG. 15 and perpendicular to the surface of the paper on which FIG. 17 is drawn). Held parts 46*b* and 46*c* are disposed at one end of the stirrer 44 and the other end of the stirrer 44 in the axial direction of the stirrer 44, respectively.

Specifically, the hollow member 46 is made of resin. The held parts 46*b* and 46*c* at the both ends of the stirrer 44 have a larger outer diameter than the main part of the hollow member 46 (a portion around which the coil 45 winds). The hollow part 46*a* penetrates the hollow member 46 from the one end to the other end of the stirrer 44.

The hollow part 46*a* may be anything as long as the piercing shaft 47 to be described later can be inserted into the hollow part 46*a* and is not limited to a closed space with a hollow space closed in the circumferential direction (or one not having openings except at both ends).

The coil 45 of the stirrer 44 includes small coils 45*e* formed at both ends of the coil 45. The small coils 45*e* have the same inner diameter as the outer diameter of the hollow member 46 and fit into the hollow member 46. Thus, the coil 45 is held by the hollow member 46 so as to cover the hollow member 46.

The coil 45 rotates counterclockwise in FIG. 9 along with the hollow member 46 and functions as a main part of the stirrer 44. The stirrer 44 (the coil 45) stirs toner in a region of the toner storage 31 where the agitator 33 does not sufficiently stir. The piercing shaft 47 is disposed in the region to rotate the first and second rotation portions 42 and 43 in conjunction with each other. That is, if only the agitator 33 stirs toner in the toner storage 31 without the stirrer 44, the agitator 33 contacts the piercing shaft 47, thereby forming a dead space in which the agitator 33 does not sufficiently stir toner in the toner storage 31. Therefore, toner staying in the dead space may be agglomerated, causing a toner supply failure. In the present embodiment, since the stirrer 44 sufficiently stirs toner, such a dead space is not formed, thereby preventing toner from being agglomerated in the toner container 30 (the toner storage 31).

In the present embodiment, the piercing shaft 47 is inserted into the hollow part 46*a* of the hollow member 46 included in the stirrer 44. The piercing shaft 47 and the stirrer 44 (the hollow member 46) independently rotate each other.

Specifically, the shaft cross-section of the piercing shaft 47 is circular, and the hole cross-section of the hollow part 46*a* of the hollow member 46 is circular. The hole cross-section has a slightly larger diameter than the shaft cross-section. With such a configuration, irrespective of the rotation of the stirrer 44 to stir toner in the toner storage 31, the piercing shaft 47 can be rotated by the lever 39 manually operated, thereby rotating the first and second rotation portions 42 and 43 (, the first and second shutters 40 and 41, and the first and second cartridge shutters 63 and 73) in conjunction with each other.

The stirrer 44 is rotated by contact of the coil 45 with the agitator (the rotator) 33.

Specifically, as driving force is transmitted from the image forming apparatus 100 to the coupling disposed at an end of the agitator 33 in the axial direction, the agitator 33 rotates clockwise in FIG. 17, and the rigid body 33*b* of the agitator 33 impacts the coil 45 (the plurality of divided coil portions 45*a* to 45*d*). The impact of the rigid body 33*b* elastically deforms the coil 45 (the plurality of divided coil portions 45*a* to 45*d*), and the stirrer 44 (the coil 45) rotates counterclockwise in FIG. 17 by repulsive force indicated by a white arrow in FIG. 17, which is the force for the coil 45 to return to the original shape, thereby stirring toner. Since the rigid body 33*b* of the agitator 33 impacts the coil 45 (the plurality of divided coil portions 45*a* to 45*d*) twice during one revolution of the agitator 33, the stirrer 44 rotates slowly, and a rotational load of the agitator 33 does not become too large.

Thus, the stirrer 44 is rotated by contact of the stirrer 44 with the agitator 33, not by gears. Therefore, a whole driver of the toner container 30 can be simplified.

In the present embodiment, even if the piercing shaft 47 is disposed away from the shaft of the agitator 33, the dead space of toner is not formed in the toner storage 31. Accordingly, the opening and closing mechanism of the first and second shutters 40 and 41 (and the first and second cartridge shutters 63 and 73) can be freely laid out. Therefore, the flexibility of design can be improved.

Note that, if the hollow member 46 completely covers the piercing shaft 47, the piercing shaft 47 that penetrates the toner storage 31 is not contaminated with toner.

As illustrated in FIGS. 15 to 17, the coil 45 according to the present embodiment is divided into the plurality of divided coil portions 45*a* to 45*d* in the axial direction of the stirrer 44. The axial direction is the left and right direction in FIG. 15 and the same as the width direction of the toner container 30.

Respective coil centers of the plurality of divided coil portions 45*a* to 45*d* are eccentric relative to the shaft center of the hollow member 46 and disposed surrounding the shaft center of the hollow member 46 as viewed in the axial direction of the stirrer 44. Specifically, with reference to FIG. 17, the coil center of the first divided coil portion 45*a* is disposed opposite the coil center of the third divided coil portion 45*c* across the shaft center of the hollow member 46. The coil center of the second divided coil portion 45*b* is disposed opposite the coil center of the fourth divided coil portion 45*d* across the shaft center of the hollow member 46. Further, the plurality of coil centers of the four divided coil portions 45*a* to 45*d* are disposed on the circumference of the circle concentric to the outer circumference of the hollow member 46 and at positions equally spaced each other in the circumference direction of the circle.

With such a configuration, regardless of the posture of the coil 45 in the rotation direction of the stirrer 44 due to impact of the agitator 33 (the rigid body 33*b*), one of the four divided coil portions 45*a* to 45*d* can be constantly located at a contactable position with the agitator 33. That is, if a coil center of the coil 45 is not eccentric, and the coil 45 is disposed on a circle concentric to the outer circumference of the hollow member 46 and uniformly formed across the axial direction of the stirrer 44, the coil 45 that the agitator 33 impacts is bent at a center portion in the axial direction of the stirrer 44 and buried in toner in the toner storage 31, causing inconvenience (a stirring failure) in which the coil 45 stops rotating (or the coil 45 does not smoothly rotate). In the present embodiment, four divided coil portions 45*a* to 45*d* are eccentric in different directions, respectively, thereby preventing the above-described inconvenience.

In the present embodiment, the agitator 33 (the rigid body 33*b*) impacts one of the four divided coil portions 45*a* to 45*d*, thereby reducing a load of the impact.

In the present embodiment, the coil 45 including the four divided coil portions 45*a* to 45*d* (and the two small coils 45*e*) is formed by winding a single wire, and end portions of coils adjacent to each other are coupled to each other.

With reference to FIG. 15, the toner container 30 (the toner storage 31) further includes holders 59*a* and 59*b* to hold the held parts 46*b* and 46*c* of the hollow member 46 at one end of the stirrer 44 and the other end of the stirrer 44 in the axial direction, respectively, thereby holding the stirrer 44.

The piercing shaft 47 is inserted into the hollow part 46*a* of the hollow member 46 from the outside of the toner container 30 through a through-hole 59*d* and holds the stirrer 44 while the stirrer 44 is held by the holders 59*a* and 59*b*.

Specifically, the toner container 30 (the toner storage 31) can be divided into an upper case 58 and a lower case 59 as illustrated in FIGS. 9 and 15. The lower case 59 is a box-shaped case including a bottom, and side walls 59*e*, 59*f*, and the like, surrounding the four sides of the bottom. The upper case 58 engages with the lower case 59 at positions indicated by dashed circles in FIGS. 9 and 15 so that the upper case 58 covers the upper opening of the lower case 59. The holders 59*a* and 59*b* and the through-holes 59*c* and 59*d* are provided in the lower case 59.

Figure 20A:
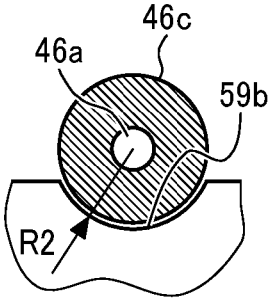
FIGS. 20A and 20B are enlarged schematic views of a holder of a lower case of the toner storage and a held part of the stirrer as viewed in an axial direction of the stirrer.
Figure 20B:
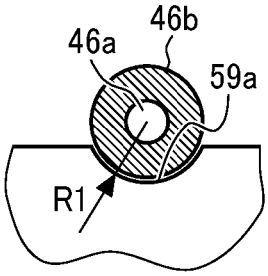

More Specifically, with reference to FIGS. 20A and 20B, the holders 59*a* and 59*b* are disposed adjacent to the two side walls 59*e* and 59*f*, respectively, in the lower case 59 and are concave upward. Specifically, the holders 59*a* and 59*b* have an arc-shaped cross-section.

With reference to FIGS. 15 and 18, the through-holes 59*c* and 59*d* are disposed in the two side walls 59*e* and 59*f* located at the both ends of the lower case 59 in the axial direction of the stirrer 44 and at positions higher than (above) the holders 59*a* and 59*b* so as to penetrate the side walls 59*e* and 59*f* In the present embodiment, the through-holes 59*c* and 59*d* are holes of bearings and indirectly formed in the side walls 59*e* and 59*f*. Alternatively, through-holes can be directly formed in the side walls 59*e* and 59*f* Packings, such as G seals, V rings, or the like, are preferably provided with the through-holes 59*c* and 59*d* to prevent toner from leaking through a gap between the piercing shaft 47 and the through-holes 59*c* and 59*d*.

With reference to FIG. 15, a length N1 of the hollow member 46 is shorter than a distance M2 between inner surfaces of the two side walls 59*e* and 59*f* in the axial direction of the stirrer 44 (i.e., N1<M2). A length N2 of the piercing shaft 47 is longer than a distance M1 between outer surfaces of the two side walls 59*e* and 59*f* in the axial direction of the stirrer 44 (i.e., N2>M1).

Figure 18A:
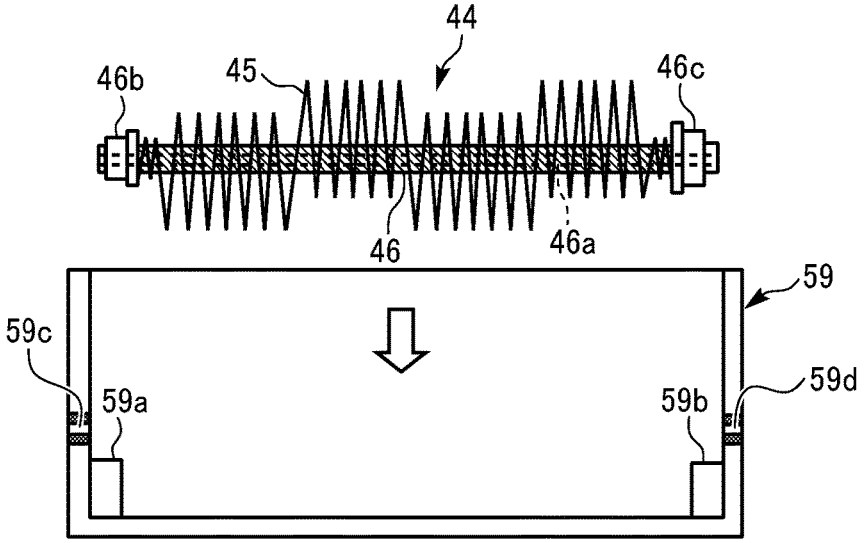
FIGS. 18A to 18C are schematic views illustrating processes of installing the stirrer and the agitator in the toner storage of the toner container.

The stirrer 44 is placed in the lower case 59 in a state in which the upper case 58 is removed from the toner container 30 as illustrated in FIG. 18A so that the held parts 46*b* and 46*c* of the hollow member 46 fit to the holders 59*a* and 59*b* of the lower case 59.

Figure 18B:
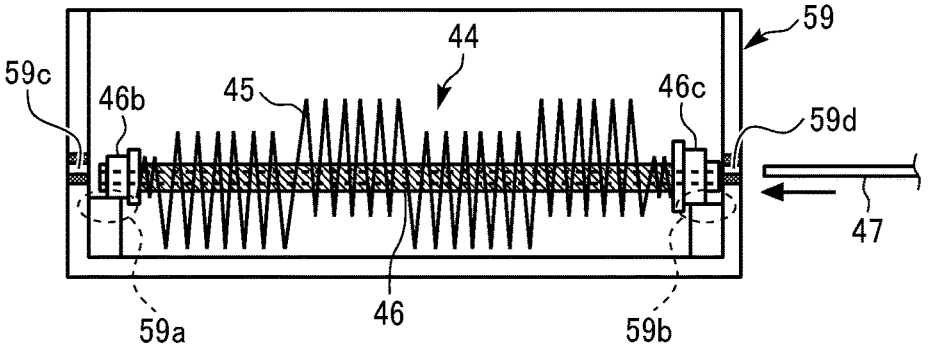
Figure 18C:
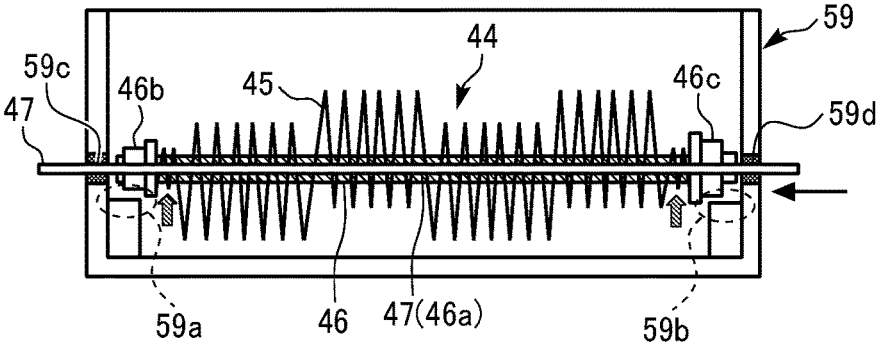

As illustrated in FIG. 18B, the piercing shaft 47 is inserted into the hollow part 46*a* of the stirrer 44 placed in the lower case 59, from the outside of the toner container 30 through one of the through-holes 59*c* and 59*d* (i.e., the through-hole 59*d* on the right side in the example of FIG. 18B) of the two side walls 59*e* and 59*f* Then, the piercing shaft 47 penetrates the through-holes 59*c* and 59*d* of the two side walls 59*e* and 59*f* and is held by the lower case 59 as illustrated in FIG. 18C.

That is, in the process of manufacturing the toner container 30, an operator holds and inserts the stirrer 44 into the lower case 59 from above as illustrated in FIG. 18A and places the stirrer 44 on the holders 59*a* and 59*b*. Then, as illustrated in FIG. 18B, the operator inserts the piercing shaft 47 into the through-hole 59*d* on the right side from the outside of the toner container 30 and further inserts the piercing shaft 47 into the hollow part 46*a* of the stirrer 44 placed in the lower case 59. The operator moves the piercing shaft 47 to the left in FIG. 18C. Thus, the piercing shaft 47 penetrates the hollow part 46*a* and the through-hole 59*c* on the left side, to the outside of the toner container 30 as illustrated in FIG. 18C. Subsequently, the upper case 58 is attached to the lower case 59 in which the stirrer 44 and the piercing shaft 47 are installed as illustrated in FIG. 15.

In the present embodiment, the piercing shaft 47 is installed in the toner container 30 from the through-hole 59*d* on the right side in FIG. 18B. Alternatively, the piercing shaft 47 can be installed in the toner container 30 from the through-hole 59*c* on the left side in FIG. 18B.

Thus, the toner container 30 according to the present embodiment includes the piercing shaft 47 that is inserted into the hollow part 46*a* of the hollow member 46 from the outside of the toner container 30 through the through-hole 59*d* and holds the stirrer 44 while the stirrer 44 is held by the holders 59*a* and 59*b*.

Therefore, even if the stirrer 44 is rotatably held in the toner container 30 that is box-shaped, inconveniences, such as that it takes time and effort to assemble the toner container 30 or an assembly failure occurs in the manufacturing process, do not occur, thereby improving assembly efficiency of the toner container 30.

The stirrer 44 according to the present embodiment includes the coil 45. In a case of assembly of the piercing shaft 47 without the hollow member 46 and the holders 59*a* and 59*b*, an operator inserts the piercing shaft 47 into the inside of the coil 45 from the outside of the toner container 30, while holding the coil 45 by hand by the operator. Therefore, unignorable inconvenience that the piercing shaft 47 is entangled with the coil 45 is caused. Further, the coil 45 according to the present embodiment includes the plurality of divided coil portions 45*a* to 45*d* eccentric in four directions. Accordingly, the piercing shaft 47 is more likely to be entangled with the divided coil portions 45*a* to 45*d* without the hollow member 46 when inserted.

On the other hand, in the present embodiment, since the piercing shaft 47 moves inside the hollow member 46 in series of operations in which the piercing shaft 47 is inserted into the stirrer 44 (the coil 45) as illustrated in FIGS. 18A to 18C, the piercing shaft 47 is not entangled with the coil 45. Therefore, the assembly efficiency of the toner container 30 is improved.

In the present embodiment, as described above with reference to FIG. 15, the length N1 of the stirrer 44 is shorter than the distance M2 between the inner surfaces of the two side walls 59*e* and 59*f* in the axial direction of the stirrer 44 (i.e., N1<M2). Therefore, the lower case 59 is formed in a box shape without configurations in which the two side walls 59*e* and 59*f* are splittable relative to the bottom, or splittable up and down based on positions of the through-holes 59*c* and 59*d* of the two side walls 59*e* and 59*f* As a result, toner leak from the lower case 59 is prevented without providing seal at a seam of the split lower cases.

With reference to FIG. 18C, the hollow member 46 (the stirrer 44) is held by the toner container 30 via the piercing shaft 47 in a state in which the held parts 46*b* and 46*c* are away from (not in contact with) the holders 59*a* and 59*b* of the lower case 59.

Figure 19A:
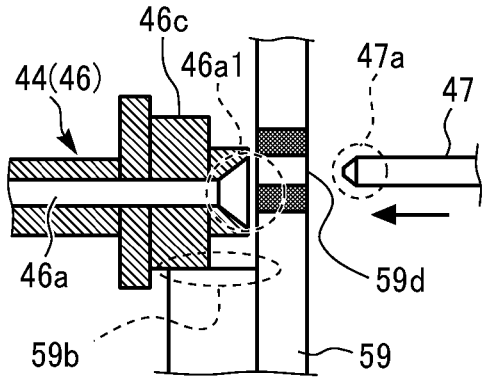
FIGS. 19A and 19B are enlarged schematic views illustrating operations of inserting the piercing shaft into a hollow part of a hollow member of the stirrer.
Figure 19B:
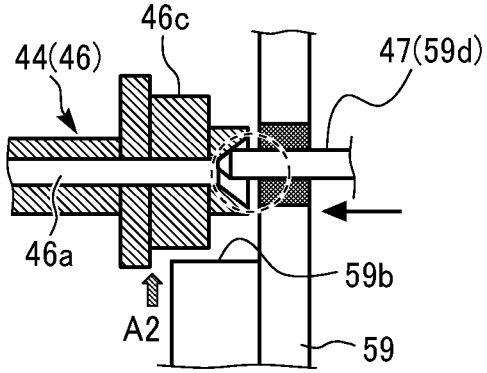

Specifically, as illustrated in FIGS. 19A and 19B, the hollow part 46*a* of the hollow member 46 is funnel-shaped at an end portion of the hollow part 46*a* and has a hole diameter of the end portion of the hollow part 46*a* gradually decreasing toward the center of the hollow member 46 in the width direction of the toner container 30. That is, a funnel-shaped portion 46*a*1 is disposed at the end portion of the hollow part 46*a* of the hollow member 46 in the width direction of the toner container 30. An end portion of the piercing shaft 47 is tapered so that a shaft diameter of the piercing shaft 47 gradually increases toward the center of the piercing shaft 47 in the width direction of the toner container 30. That is, a tapered portion 47*a* is disposed at the end portion of the piercing shaft 47 in the width direction of the toner container 30.

With such a configuration, as the piercing shaft 47 moves toward the hollow part 46*a* of the hollow member 46 held by the holder 59*b*, through the through-hole 59*d* as illustrated in FIG. 19A (and FIG. 18B), the tapered portion 47*a* of the piercing shaft 47 firstly contacts the funnel-shaped portion 46*a*1 of the hollow part 46*a* as illustrated in FIG. 19B. Then, as the piercing shaft 47 keeps moving to the left, the hollow member 46 (the stirrer 44) moves upward indicated by thick arrow A2 in FIG. 19B so that the funnel-shaped portion 46*a*1 follows a slope of the tapered portion 47*a* of the piercing shaft 47. As the piercing shaft 47 reaches the other end of the hollow part 46*a* and the through-hole 59*c* on the other end side of the stirrer 44, the stirrer 44 is held by the lower case 59 via the piercing shaft 47 in a state in which the stirrer 44 is away from (not in contact with) the holders 59*a* and 59*b*.

Thus, when the stirrer 44 stirs toner in the toner storage 31, the holders 59*a* and 59*b* do not cause sliding resistance. Therefore, the stirrer 44 satisfactorily rotates, and abrasion deterioration of the holders 59*a* and 59*b* and the held parts 46*b* and 46*c* due to rotation of the stirrer 44 is prevented.

The through-hole 59*c* on the other end side is preferably tapered (a hole diameter of the through-hole 59*c* gradually decreases from the inside toward the outside of the toner container 30) so that the piercing shaft 47 satisfactorily fits into the through-hole 59*c* on the other end side when the piercing shaft 47 reaches the other end of the hollow part 46*a*.

Further, in the toner container 30 according to the present embodiment, the stirrer 44 (the hollow member 46) is not held by the holders 59*a* and 59*b* when the stirrer is inverted in the width direction of the toner container 30 (i.e., the stirrer 44 reversed in the left and right direction in FIGS. 18A to 18C). The stirrer 44 according to the present embodiment has directionality in the width direction of the divided coil portions 45*a* to 45*d*. If an arrangement of the stirrer 44 in the width direction is reversed, the stirrer 44 may not be rotated sufficiently by contact with the agitator 33. Therefore, a configuration that prevents the stirrer 44 from being inverted in the width direction is useful.

Specifically, as illustrated in FIGS. 20A and 20B, the holder 59*b* of the lower case 59 on one end side in the axial direction of the stirrer 44 has a concave shape different from the holder 59*a* of the lower case 59 on the other end side in the axial direction of the stirrer 44. More specifically, a radius R2 of the concave shape of the holder 59*b* on one end side illustrated in FIG. 20A is greater than a radius R1 of the concave shape of the holder 59*a* on the other end side illustrated in FIG. 20B (i.e., R2>R1).

The two held parts 46*b* and 46*c* of the hollow member 46 have different shapes that fit to the corresponding holders 59*a* and 59*b* with different shapes, respectively. Specifically, an outer diameter (R2×2) of the held part 46*c* on the one end side illustrated in FIG. 20A is greater than an outer diameter (R1×2) of the held part 46*b* on the other end side illustrated in FIG. 20B.

With such a configuration, if the stirrer 44 is inverted in the width direction, the held parts 46*b* and 46*c* do not fit to the holders 59*b* and 59*a*, respectively, thereby preventing the stirrer 44 from being installed in the toner container 30.

In the present embodiment, as illustrated in FIG. 15, a distance N3 between outer surfaces of the two held parts 46*b* and 46*c* of the hollow member 46 is longer than a distance M3 between inner surfaces of the two holders 59*a* and 59*b* by a predetermined value α in the axial direction of the stirrer 44 (i.e., N3=M3+α). The predetermined value α is set so that the stirrer 44 is reliably held by the holders 59*a* and 59*b* when normally placed, and the held parts 46*b* and 46*c* are not held by the holders 59*a* and 59*b* when abnormally placed. When the stirrer 44 is abnormally placed, for example, when the stirrer 44 is inclined to the width direction of the toner container 30, a span between the holders 59*a* and 59*b* is insufficient. Accordingly, the held parts 46*b* and 46*c* are not held and drops out of the holders 59*a* and 59*b*.

With such a configuration, if an operator attempts to place the hollow member 46 (the stirrer 44) with a large inclination relative to the axial direction or invert the hollow member 46 in the width direction, the held parts 46*b* and 46*c* do not fit to the holder 59*a* and 59*b*, thereby preventing the stirrer 44 from being installed in the toner container 30.

Figure 21:
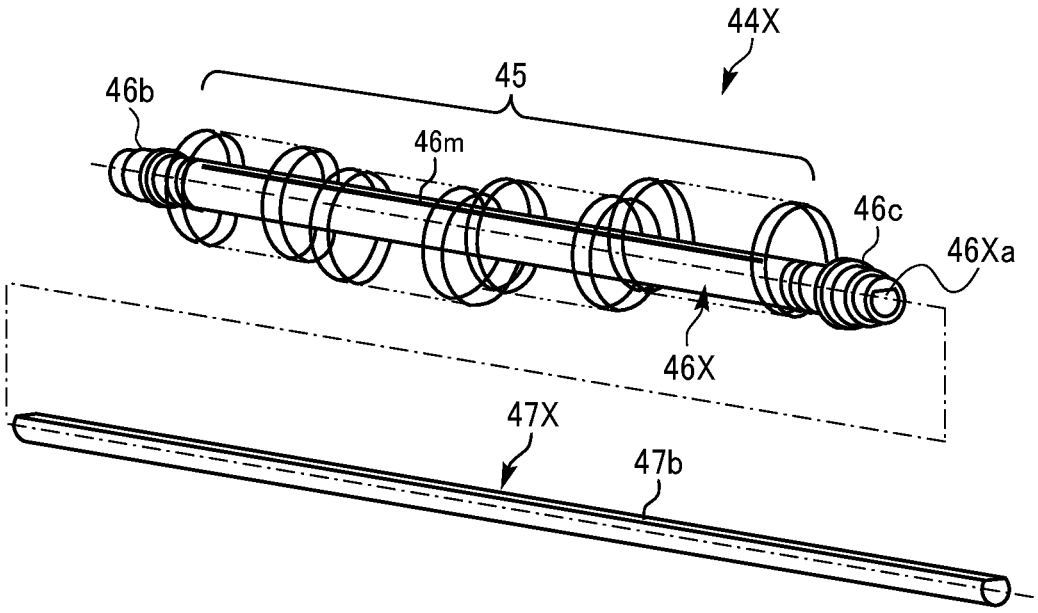
FIG. 21 is a perspective view of a stirrer and a piercing shaft installed in a toner storage according to a first variation of the present disclosure.
Figure 22A:
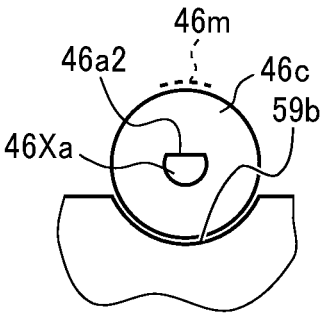
FIGS. 22A and 22B are enlarged schematic views of a holder of a lower case of the toner storage and a held part of a stirrer as viewed in an axial direction of the stirrer according to the first variation of the present disclosure.
Figure 22B:
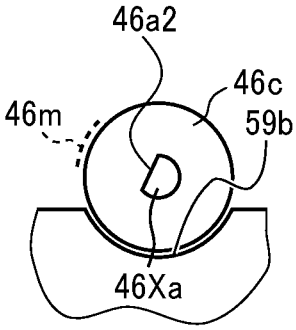

FIG. 21 is a perspective view of a stirrer 44X and a piercing shaft 47X installed in the toner storage 31 according to a first variation of the present disclosure. FIGS. 22A and 22B are enlarged schematic views of the holder 59*b* of the lower case 59 of the toner storage 31 and the held part 46*c* of the stirrer 44X as viewed in the axial direction of the stirrer 44X according to the first variation of the present disclosure.

In the toner storage 31 according to the first variation, a configuration in which the stirrer 44X and the piercing shaft 47X rotate together is different from the configuration of the above-described embodiment in which each of the stirrer 44 and the piercing shaft 47 rotates independently.

Specifically, as illustrated in FIGS. 21, 22A, and 22B, a hollow part 46Xa of a hollow member 46X is D-shaped across the width direction. That is, a part of the hollow part 46Xa has a flat portion 46*a*2. The piercing shaft 47X has a milling surface 47*b*, which is flat corresponding to the flat portion 46*a*2, on a circumference of the piercing shaft 47X.

Therefore, as the piercing shaft 47X rotates in a state in which the piercing shaft 47X is inserted into the hollow member 46X (the hollow part 46Xa), the stirrer 44X rotates together with the piercing shaft 47X. Such a configuration is useful when the piercing shaft 47X does not function to simultaneously rotate the first and second rotation portions 42 and 43, and the stirrer 44X is independently rotated relative to the agitator 33, not by contact with the agitator 33. Accordingly, when the piercing shaft 47X is installed in the toner storage 31, a gear is attached to or a motor is directly coupled to an end of the piercing shaft 47X that projects to the outside of the toner storage 31.

In the case of the configuration according to the first variation, when the piercing shaft 47X is inserted into the hollow member 46X, orientations in the rotation direction of the stirrer 44X match each other between the flat portion 46*a*2 of the hollow member 46 and the milling surface 47*b* of the piercing shaft 47X. On an outer circumferential surface of the hollow member 46X, a mark 46*m* is formed to determine the orientation of the flat portion 46*a*2 in the rotation direction of the stirrer 44X. The stirrer 44X (the hollow member 46X) is placed on the holders 59*a* and 59*b* with the mark 46*m* facing upward. That is, the held part 46*c* of the stirrer 44 is oriented relative to the holder 59*b* of the lower case 59 as illustrated in FIG. 22A, not in FIG. 22B. Subsequently, the piercing shaft 47X with the milling surface 47*b* facing upward is inserted through the through-hole 59*d* into the hollow part 46Xa of the stirrer 44X (the hollow member 46X) placed in the lower case 59 with the flat portion 46*a*2 facing upward. In the manufacturing processes of the first variation, the piercing shaft 47X is inserted into the hollow member 46X while the flat portion 46*a*2 and the milling surface 47*b* face upward. Alternatively, the piercing shaft 47X can be inserted into the hollow member 46X while the flat portion 46*a*2 and the milling surface 47*b* face a predetermined direction other than upward.

Therefore, similarly to the above-described embodiment, the assembly efficiency of the toner container 30 is improved with such a configuration according to the first variation.

Figure 23:
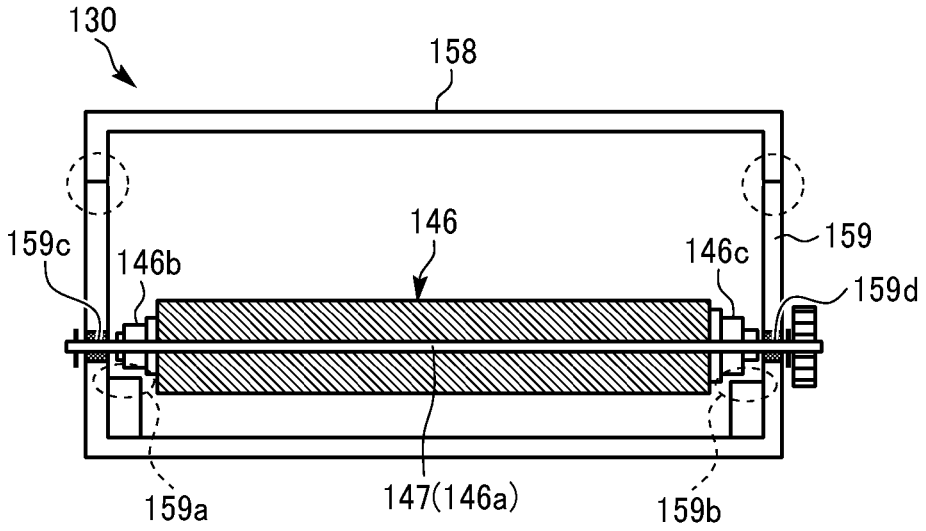
FIG. 23 is a schematic view illustrating a part of a mechanical device according to a second variation of the present disclosure.

FIG. 23 is a schematic view illustrating a main part of a mechanical device 130 according to a second variation. FIG. 23 corresponds to FIG. 15 in the above-described embodiment.

The mechanical device 130 according to the second variation is not limited to the toner container 30 of the image forming apparatus 100 and is an example of one of mechanical devices 130 including a rotator 146. Such mechanical devices include, for example, the developing device 5, the fixing device 20 in the image forming apparatus 100 according to the above-described embodiment, and a mechanical device, which does not store powder, other than the image forming apparatus 100 (e.g., a camera, a projector, and the like).

As illustrated in FIG. 23, the mechanical device 130 according to the second variation includes a rotator 146, holders 159*a* and 159*b*, and a piercing shaft 147.

Inside the rotator 146, the hollow part 146*a* extends in the axial direction of the rotator 146. Held parts 146*b* and 146*c* are disposed on one end side of the rotator 146 and the other end side of the rotator 146 in the axial direction of the rotator 146, respectively.

The mechanical device 130 further includes holders 159*a* and 159*b* to hold the held parts 146*b* and 146*c* of the rotator 146 at one end of the rotator 146 and the other end of the rotator 146 in the axial direction, respectively, thereby holding the rotator 146.

The piercing shaft 147 is inserted into the hollow part 146*a* of the rotator 146 from the outside of the mechanical device 130 through a through-hole 159*d* (or 159*c*) and holds the rotator 146 in a state in which the rotator 146 is held by the holders 159*a* and 159*b*.

The mechanical device 130 can be divided into an upper case 158 and a lower case 159 including the holders 159*a* and 159*b* and through-holes 159*c* and 159*d*.

Therefore, with processes similar to the processes of the toner container 30 according to the above-described embodiment, the rotator 146 and the piercing shaft 147 are installed in the mechanical device 130. As a result, the assembly efficiency of the mechanical device 130 according to the second variation is improved.

As described above, the toner container 30 (the powder container, the mechanical device) according to the above-described embodiments includes the hollow member 46 to which the held parts 46*b* and 46*c* are attached at ends of the hollow member 46, the coil 45 held by the hollow member 46, the holders 59*a* and 59*b* to hold the held parts 46*b* and 46*c* of the hollow member 46 at end portions in the toner container 30, and the piercing shaft 47 that is inserted into the hollow part 46*a* of the hollow member 46 from the outside of the toner container 30 through the through-hole 59*d* while the hollow member 46 is held by the holders 59*a* and 59*b*.

Therefore, the assembly efficiency of the toner container 30 can be improved.

As a result, according to embodiments of the present disclosure, a powder container, a process cartridge, an image forming apparatus, and a mechanical device can be provided to improve assembly efficiency of the powder container (the mechanical device).

In the above-described embodiments, the present disclosure is applied to the process cartridge 10 as a single unit including the photoconductor drum 1 (an image bearer), the charging roller (a charger) 4, the developing device 5, the cleaner 2, and the waste toner conveyor 6. However, the present disclosure is not limited to the embodiments described above and applied to the image forming apparatus 100 in which the above-describe devices (i.e., the photoconductor drum 1 as the image bearer, the charging roller 4, the developing device 5, the cleaner 2, and the waste toner conveyor 6) are removably installed as a single unit.

In such configurations, similar effects to the embodiments described above are also attained.

It is to be noted that the term "process cartridge" used in the present disclosure means a removable device (a removable unit) including an image bearer and at least one of a charger to charge the image bearer, a developing device to develop latent images on the image bearer, and a cleaner to clean the image bearer that are united together, and is designed to be removably installed as a united part in the apparatus body of the image forming apparatus.

In the above-described embodiments, the present disclosure is applied to the toner container (the powder container) 30 included in the image forming apparatus 100 that performs monochrome image formation. Alternatively, the present disclosure may be applied naturally to a toner container (a powder container) included in a color image forming apparatus.

In the above-described embodiments, the present disclosure is applied to the toner container (the powder container) 30 indirectly installed in and removed from the image forming apparatus 100 via the process cartridge 10. Alternatively, the present disclosure may be applied to a toner container (a powder container) directly installed in and removed from the image forming apparatus 100 without going through the process cartridge 10.

In the above-described embodiments, the present disclosure is applied to the toner container (the powder container) 30 to store toner (one-component developer) and supply the toner to the developing device 5 for a one-component developing method. Alternatively, the present disclosure may be applied to a toner container (a powder container) to supply toner to the developing device 5 for a two-component developing method.

In the above-described embodiments, the present disclosure is applied to the toner container (the powder container) 30 in which toner (one-component developer) as powder is stored and collected. Alternatively, the present disclosure may be applied to a toner container (a powder container) in which a two-component developer as powder is stored and collected. The two-component developer is a mixture of toner and carrier. In this case, a developing device employs the two-component developing method.

In the above-described embodiments, the present disclosure is applied to the toner container (the powder container) 30 including the toner storage 31 and the waste toner collection portion 32 as a single unit. Alternatively, the present disclosure may be applied to a toner container (a powder container) including only a waste toner collection portion (a powder collection portion).

Any of the cases described above exhibits similar effect to those of the above-described embodiments.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Desirable number, position, and shape can be determined to perform the present disclosure.

Note that, in the present disclosure, the powder container is a container configured to store powder to be used in the image forming apparatus or store used powder in the image forming apparatus. Therefore, the powder container includes a container configured to store fresh toner or a fresh developer and a container configured to store the used toner or used developer.

In the present disclosure, the width direction is perpendicular to a direction in which the toner container (the powder container) 30 is attached to the process cartridge 10. The toner container (the powder container) 30 has a longitudinal direction and a short side direction, and the width direction is the longitudinal direction of the toner container (the powder container) 30. In addition, the width direction is a direction in which the shaft of conveying screws extends.

In the present disclosure, one end side in the width direction means one portion side when the toner container 30 is divided into two portions at the center of the toner container 30. In the present disclosure, the other end side in the width direction means the other portion side when the toner container 30 is divided into two portions at the center of the toner container 30.

What is claimed is:

1. A powder container comprising:

a powder storage configured to store powder and having side walls with through-holes;

a hollow member including a hollow part;

held parts disposed at both ends of the hollow member in an axial direction of the hollow member;

a coil configured to be held by the hollow member;

holders configured to hold the held parts of the hollow member;

a piercing shaft configured to be inserted into the hollow part of the hollow member from outside of the powder container through one of the through-holes;

an upper case; and a lower case including the holder and two side walls, the two side walls constituting part of the side walls of the powder storage and having the through-holes, the two side walls disposed at both ends of the lower case in the axial direction of the hollow member, wherein the powder storage is splittable into the upper case and the lower case, wherein the holders are concave upward and disposed adjacent to the two side walls, respectively, inside the lower case, and wherein the through-holes are disposed in the two side walls, respectively, at positions higher than the holders, so as to penetrate the two side walls.

2. The powder container according to claim 1, wherein the hollow member is a shaft, and wherein a length of the hollow member is shorter than a distance between inner surfaces of the two side walls in the axial direction of the hollow member, and a length of the piercing shaft is longer than a distance between outer surfaces of the two side walls in the axial direction of the hollow member.

3. The powder container according to claim 1, wherein the held parts of the hollow member are configured to be placed from above on the holders of the lower case in a state in which the upper case is removed from the powder container, wherein the piercing shaft is configured to be inserted into the hollow part of the hollow member placed on the holders of the lower case, from the outside of the powder container through the one of the through-holes, and wherein the piercing shaft is held by the lower case in a state in which the piercing shaft penetrates the through-holes of the two side walls.

4. The powder container according to claim 1, wherein the holders have different concave shapes from each other, and wherein the held parts have different shapes that fit to the different concave shapes of the holders, respectively.

5. The powder container according to claim 1, wherein a distance between outer surfaces of the held parts of the hollow member is longer than a distance between inner surfaces of the holders by a predetermined value in the axial direction of the hollow member.

6. The powder container according to claim 1, wherein the holders and the held parts have shapes of preventing the hollow member from being held by the holders in a state in which the hollow member is inverted in the axial direction of the hollow member.

7. The powder container according to claim 1, wherein the hollow member is held by the powder container via the piercing shaft in a state in which the held part is out of contact with the holder.

8. The powder container according to claim 1, wherein the hollow member is a shaft, wherein a hole diameter of an end portion of the hollow part gradually decreases toward a center of the hollow member in the axial direction of the hollow member, and wherein a shaft diameter of the piercing shaft gradually increases toward a center of the piercing shaft in the axial direction of the hollow member.

9. The powder container according to claim 1, further comprising:

a stirrer including the hollow member and the coil; and a rotator disposed adjacent to the stirrer and configured to independently rotate relative to the stirrer, wherein the stirrer is configured to be rotated by contact of the coil with the rotator.

10. The powder container according to claim 1, further comprising:

a plurality of divided coil portions into which the coil is divided in the axial direction of the hollow member, and a plurality of coil centers of the plurality of divided coil portions being eccentric relative to a shaft center of the hollow member and disposed surrounding the shaft center of the hollow member.

11. A process cartridge comprising the powder container according to claim 1, wherein the process cartridge is installable in and removable from an image forming apparatus.

12. An image forming apparatus comprising the powder container according to claim 1.

13. A mechanical device comprising:

side walls having through-holes;

a rotator including a hollow part across an axial direction of the rotator;

held parts disposed at both ends of the rotator in the axial direction of the rotator;

holders configured to hold the held parts of the rotator;

a piercing shaft configured to be inserted into the hollow part of the rotator from outside of the mechanical device through one of the through-holes and hold the rotator;

an upper case; and a lower case including the holder and two side walls, the two side walls constituting part of the side walls and having the through-holes, the two side walls disposed at both ends of the lower case in the axial direction of the rotator, wherein the sidewalls are splittable into the upper case and the lower case, wherein the holders are concave upward and disposed adjacent to the two side walls, respectively, inside the lower case, and wherein the through-holes are disposed in the two side walls, respectively, at positions higher than the holders, so as to penetrate the two side walls.

* * * * *